US006792778B1

(12) United States Patent
Chen

(10) Patent No.: US 6,792,778 B1
(45) Date of Patent: Sep. 21, 2004

(54) COMBINATION LOCK

(75) Inventor: Cheng Jung Chen, Lugaang Village (TW)

(73) Assignee: Glox Industry Co., Ltd., Changhua (TW)

( * ) Notice: Subject to any disclaimer, the term of this patent is extended or adjusted under 35 U.S.C. 154(b) by 0 days.

(21) Appl. No.: 10/658,866

(22) Filed: Sep. 9, 2003

(51) Int. Cl.[7] ..... E05B 37/02

(52) U.S. Cl. ..... 70/21; 70/29; 70/46; 70/284; 70/285; 70/312

(58) Field of Search ..... 70/21, 29, 45–47, 70/284, 285, 312, DIG. 71

(56) References Cited

U.S. PATENT DOCUMENTS

| | | | | | |
|---|---|---|---|---|---|
| 1,117,417 | A | * | 11/1914 | Meepos | 70/29 |
| 1,300,983 | A | * | 4/1919 | Luckey | 70/437 |
| 4,325,240 | A | * | 4/1982 | Gable | 70/284 |
| 5,134,869 | A | * | 8/1992 | Gable | 70/63 |
| 5,359,867 | A | * | 11/1994 | Ling et al. | 70/28 |
| 5,782,113 | A | * | 7/1998 | Chen | 70/28 |
| 5,901,587 | A | * | 5/1999 | Chen | 70/28 |
| 6,082,155 | A | * | 7/2000 | Su | 70/22 |
| 6,381,997 | B1 | * | 5/2002 | Chen | 70/28 |
| 6,539,761 | B2 | * | 4/2003 | Yang | 70/284 |
| 6,708,534 | B1 | * | 3/2004 | Ruan | 70/38 A |
| 2002/0088256 | A1 | * | 7/2002 | Taylor et al. | 70/25 |

FOREIGN PATENT DOCUMENTS

| | | | | |
|---|---|---|---|---|
| FR | 457871 | * | 4/1913 | 70/21 |

* cited by examiner

*Primary Examiner*—Lloyd A. Gall
(74) *Attorney, Agent, or Firm*—Pro-Techtor International Services

(57) ABSTRACT

A combination lock comprises a tumbler wheel assembly, a backup locking assembly comprising a keyhole, a shaft, and an inner projection having a half circular section, a pivot assembly having a dog and an engagement member, a push button secured to the pivot assembly, a U-shaped shackle pivotably fastened at the lock housing, and an L-shaped resilient member. A correct combination of tumblers and a subsequent pressing of the push button will disengage the dog from a slot at one leg of the shackle and thus exert an elastic force of the resilient member on the leg for pushing the leg out of engagement with the lock. Should either the combination be forgotten or the combination be changed by another person, a turning of the shaft about 90 degrees by inserting a key into the keyhole will turn the projection and the engaged engagement member for releasing the dog.

3 Claims, 5 Drawing Sheets

COMBINATION LOCK

BACKGROUND OF THE INVENTION

1. Field of the Invention

The present invention relates to combination locks and more particularly to a combination lock capable of being opened by inserting a key into keyhole in addition to turning tumbler wheels to a set series of numbers for opening.

2. Description of Related Art

Combination locks are well known. Two main design problems present themselves with locks of this type. First, provision should be made to allow the combination of the lock to be changed from time to time. Secondly, provision should be made to allow the lock to be opened should the combination be forgotten. This is a particularly important feature in connection with locks that allow the combination to be changed readily, since it sometimes happens that when changing the combination periodically, the owner thereof will forget to what combination it was last set. Thus, continuing improvements in the exploitation of combination lock are constantly being sought.

SUMMARY OF THE INVENTION

It is an object of the present invention to provide a combination lock comprising a housing comprising a plurality of parallel, spaced seats each having a substantially half circular recess thereon, an elongate groove adjacent one sides of the seats, a cavity at a side in communication with both the groove and the seats, a channel in communication with both outside and the cavity, a pin in the cavity proximate one end of the groove, a receptacle adjacent the pin, and an opening in communication with both the cavity and outside; a tumbler wheel assembly supported on the recesses and comprising a plurality of tumbler wheels, a plurality of inner, hollow cylinders each fitted in the tumbler wheel, a bar locked by the cylinders in a locked position, and a flat enlargement at one end adjacent the opening, a first spring put on the bar being compressed between the enlargement and one of the cylinders; a backup locking assembly disposed in the groove and comprising a keyhole and a rotatable shaft including a projection having a half circular section protruded from an inner end thereof toward the cavity; a pivot assembly in the cavity and comprising a hole pivotably put on the pin, a latch having a locking dog at an open end, an engagement member engaged with the flat of the projection in the locked position, a base, a protrusion on the base, a protuberance extended in a direction perpendicular to that of the protrusion, and a second spring compressed between the protuberance and the receptacle; a push button secured to the pivot assembly at the hole and comprising a nose at an inner side to urge against the enlargement, and an arm urged outward by the protrusion for closing the opening in the locked position; a U-shaped shackle comprising a first leg pivotably fastened at the housing, a second leg, a slot at one end of the second leg, the slot being engaged with the dog in the locked position; a cover fitted on the housing; and an L-shaped resilient member having a horizontal portion fastened at a wall of the backup locking assembly and a vertical portion bent by the dog in the locked position.

In one aspect of the present invention, a correct combination of the tumbler wheels will unlock the bar, and a pressing of the push button will push the enlargement and further compress the first spring, thereby pivoting both the push button and the pivot assembly about the pin, compressing the second spring, disengaging the dog from the slot, and exerting an elastic force of the energized resilient member on the second leg for pushing the second leg out of the channel for unlocking the lock by returning to the original L-shape thereof.

In another aspect of the present invention should either the combination be forgotten or the combination be changed by another person who shares the ownership of the lock, a turning of the shaft about 90 degrees by inserting a key into the keyhole will change the flat of the projection engaged with the engagement member in a first position to the sharp edge of the projection engaged with the engagement member in a second position so as to push the engagement member to pivot the pivot assembly, disengage the dog from the slot, and exert the elastic force of the energized resilient member on the second leg for pushing the second leg out of the channel for unlocking the lock by returning to the original L-shape thereof.

The above and other objects, features and advantages of the present invention will become apparent from the following detailed description taken with the accompanying drawings.

DETAILED DESCRIPTION OF THE PREFERRED EMBODIMENTS

Figure 1:
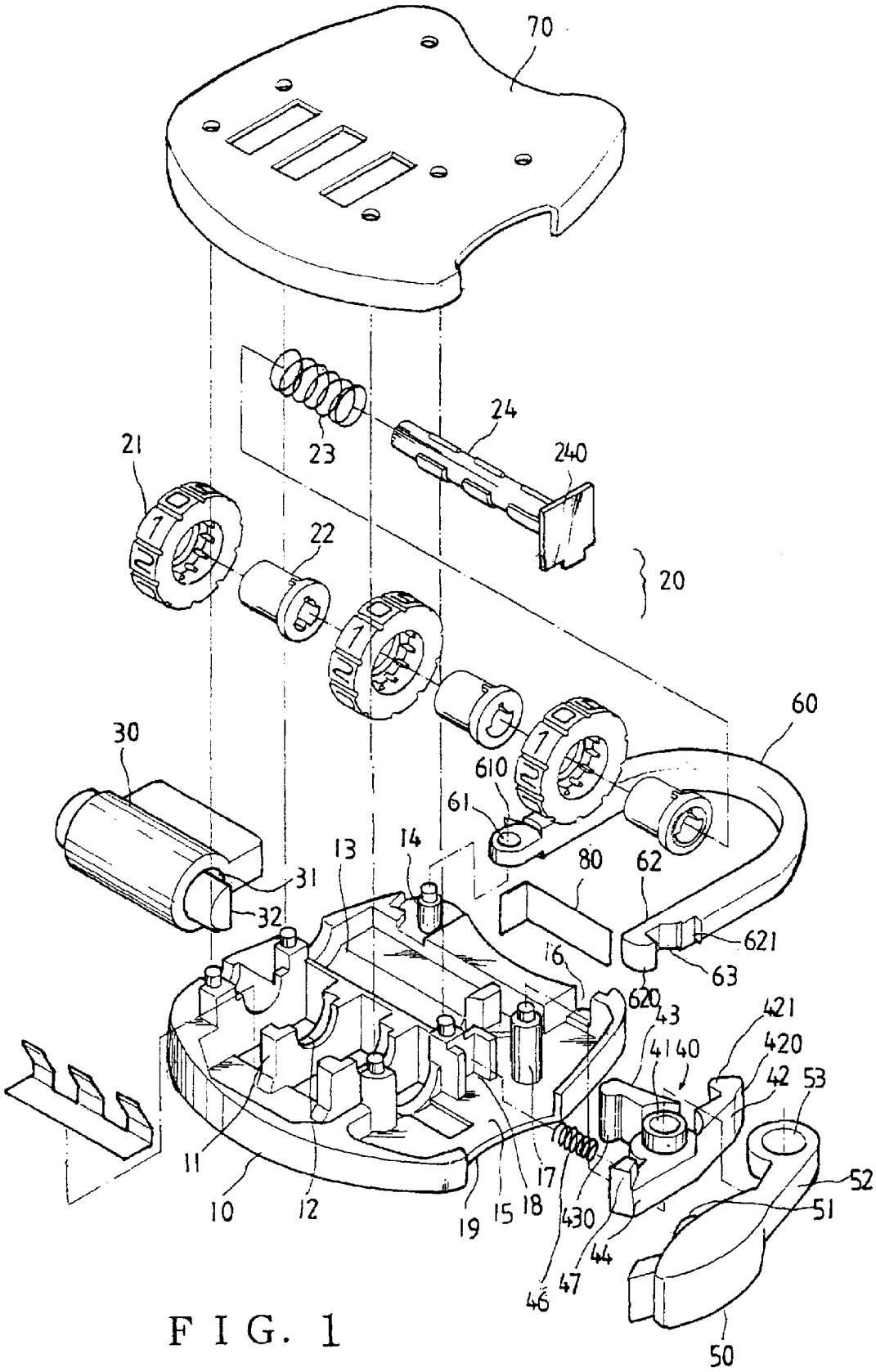
FIG. 1 is an exploded view of a preferred embodiment of combination lock according to the invention.
Figure 2:
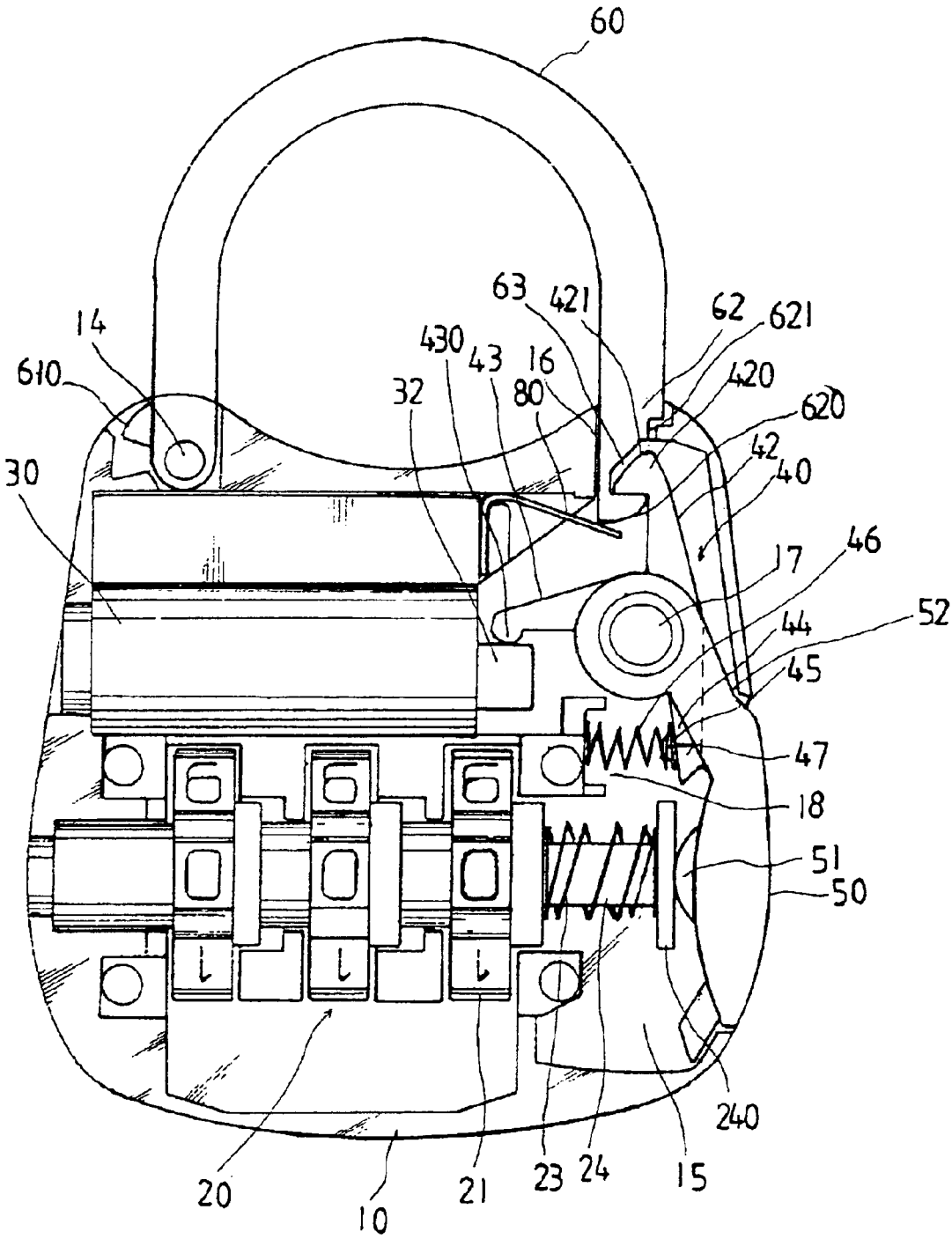
FIG. 2 is a cut-away side view of the assembled combination lock.
Figure 3:
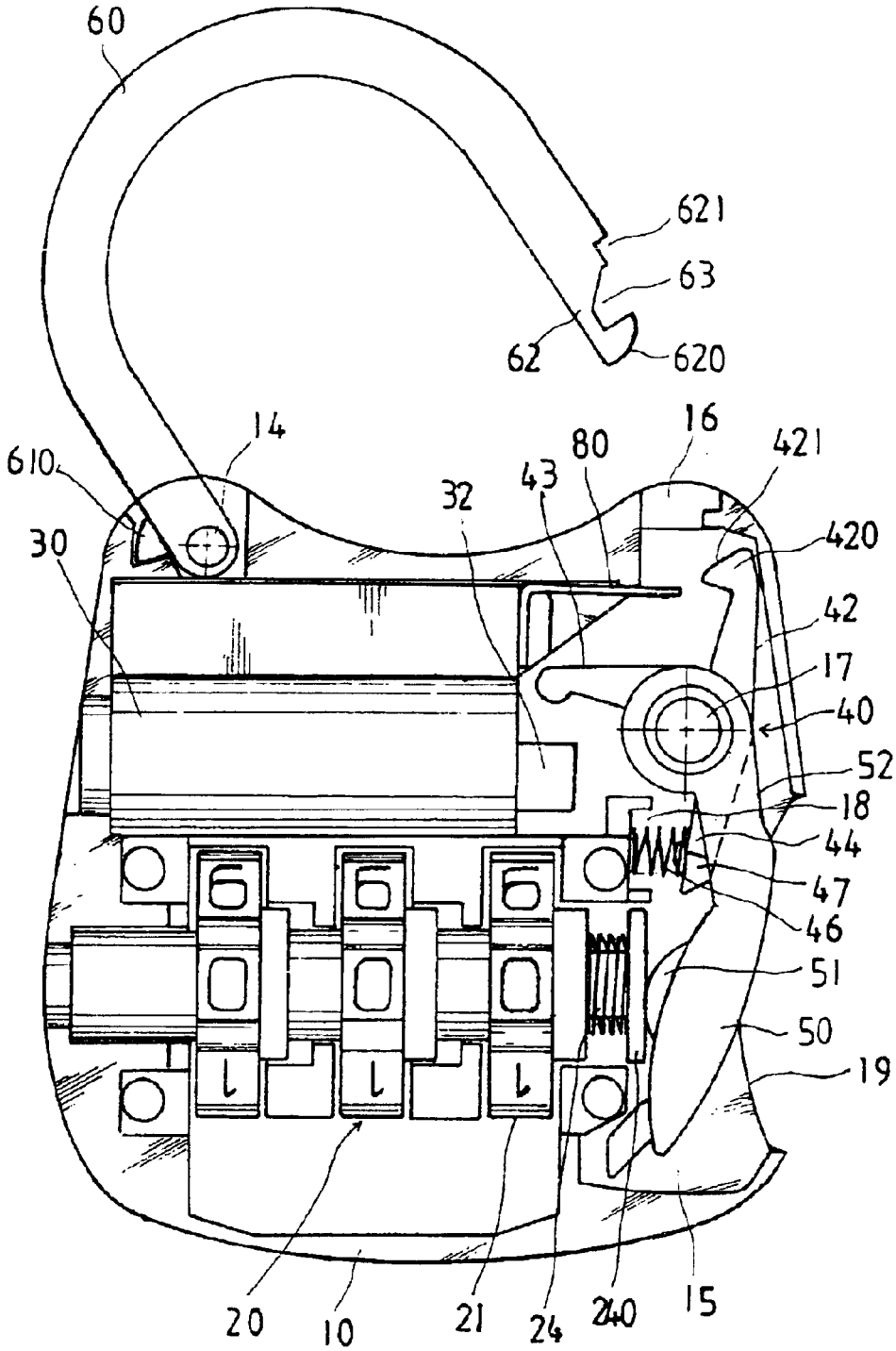
FIG. 3 is a view similar to FIG. 2, where the lock is opened.
Figure 4:
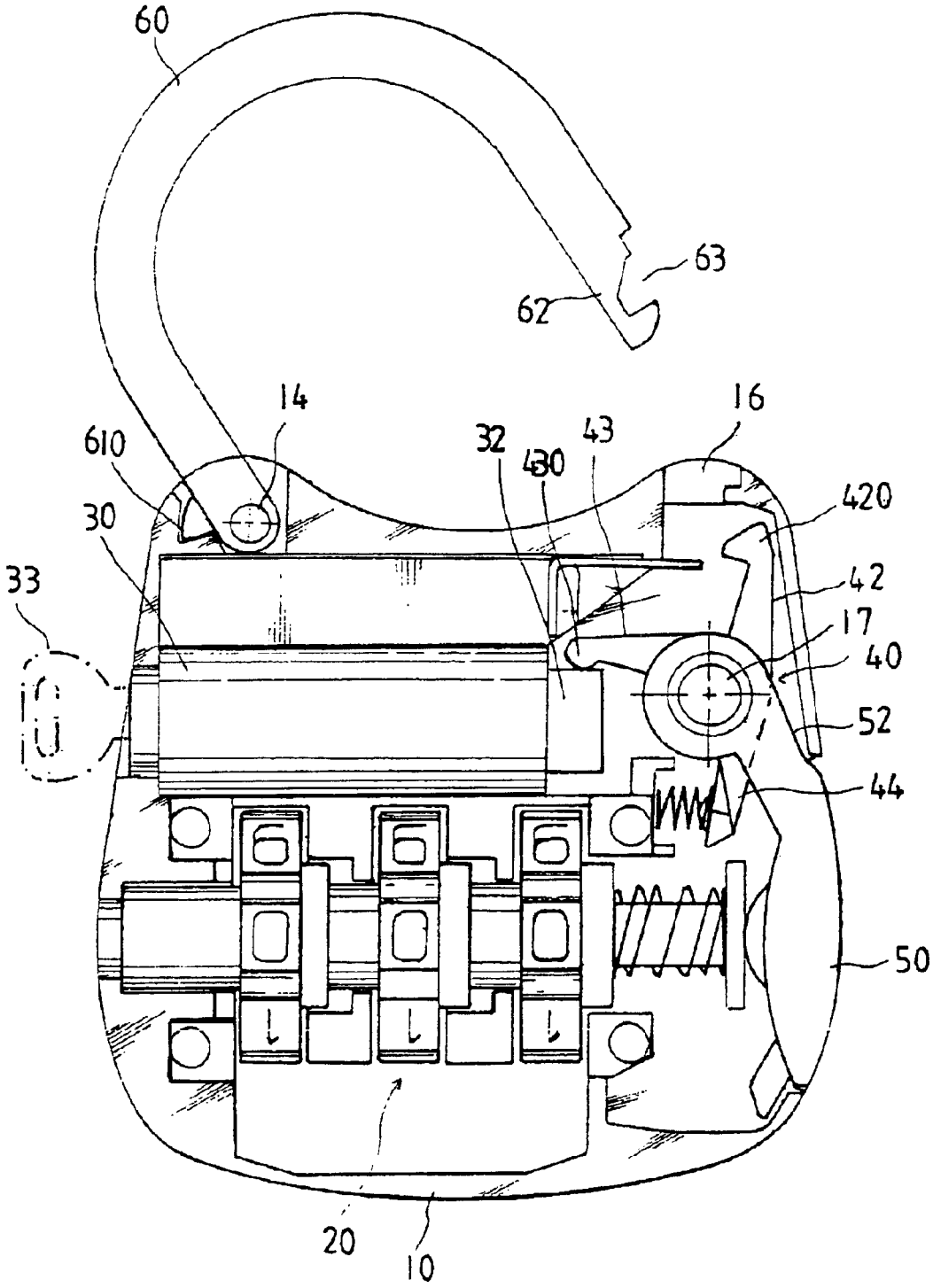
FIG. 4 is a view similar to FIG. 3, where the lock is opened by inserting a key into keyhole when the combination has been forgotten or the combination has been changed by another person who shares the ownership of the lock.

Referring to FIGS. 1, 2, 3 and 4, there is shown a combination lock constructed in accordance with the invention. The lock comprises a housing 10, a tumbler wheel assembly 20, a backup locking assembly 30, a pivot assembly 40, a push button 50, a U-shaped shackle 60, a cover 70, and an L-shaped resilient member 80. Each component will be described in detail below.

The housing 10 comprises three parallel, spaced seats 11 each having a substantially half circular recess 12 thereon, an elongate groove 13 adjacent one sides of the seats 11, a pin 14 adjacent the groove 13, a cavity 15 at a side in communication with both the groove 13 and the seats 11, a hole or channel 16 in communication with both the outside and the cavity 15, the hole 16 being opposite the pin 14 at one side, a pin 17 in tile cavity 15 proximate one end of the groove 13, a receptacle 18 between the seats 11 and the groove 13 and adjacent the pin 17, and an opening 19 in communication with both the cavity 15 and the outside.

The tumbler wheel assembly 20 is supported on the recesses 12 and comprises three tumbler wheels 21, three inner, hollow cylinders 22 each fitted in the tumbler wheel 21, a bar 24 having a plurality of sets of projections disposed axially along its surface and a flat enlargement 240 at one end adjacent the opening 19, a coil spring 23 put on the shank portion of the bar 24 being compressed between the enlargement 240 and the cylinder 22. The backup locking assembly 30 is disposed in the groove 13 and comprises a keyhole (not shown) and a rotatable shaft 31 having a projection 32 having a half circular section protruded from an inner end thereof toward the cavity 15.

The pivot assembly 40 is provided in the cavity 15 and comprises a hole 41 pivotably put on the pin 17, a latch extended toward the hole 16, the latch having a locking dog 420 at an open end and an arcuate slope 421 on the dog 420, an engagement member 43 having a rounded end 430 engaged with the flat of the projection 32 in a locked position, a base 44 disposed on the opening 19, a protrusion 47 on the base 44, a protuberance 45 extended in a direction perpendicular to that of the protrusion 47, and a coil spring 46 compressed between the protuberance 45 and the receptacle 18.

The push button 50 comprises a nose 51 at an inner side to urge against the enlargement 240, an arm 52 disposed on the base 44, the arm 52 being urged outward by the protrusion 47 for closing the opening 19 in the locked position, and a hole 53 at one end snugly put on the upper, annular flange on the hole 41 for enabling the push button 50 and the pivot assembly 40 together to pivot about the pin 17.

The shackle 60 comprises an aperture 61 at one leg, the aperture 61 put on the pin 14 so that the shackle 60 can pivot about the housing 10, an outer stop 610 adjacent the aperture 61 for limiting a pivot angle of the shackle 60 in an unlocked position, a slot 63 at the end of the other leg 62, the slot 63 being engaged with the dog 420 in the locked position, a notch 621 on top of the slot 63 for further fastening the dog 420 in the slot 63, and an arcuate end 620 below the slot 63 for facilitating the insertion of the other leg 62 into the hole 16 or the removal from the same. The cover 70 is fitted on top of the housing 10 by a snapping mechanism or screws known to those skilled in the art and comprises three rectangular openings (not numbered) for exposing a series of numbers of the tumbler wheels 21. The resilient member 80 has a horizontal portion fastened at a wall of the backup locking assembly 30 and a vertical portion being bent by the arcuate end 620 in the locked position.

An unlocking operation of the invention will now be described in detail below. In a normal case a person can turn the tumbler wheels 21 until the correct set series of numbers (i.e., combination) are shown on the openings of the cover 70. At this moment, the locking of the bar 24 by the cylinders 22 is unlocked. Next, the person can press the push button 50 to push the enlargement 240 and further compress the spring 23, thereby pivoting both the push button 50 and the pivot assembly 40 about the pin 17, compressing the spring 46, and disengaging the dog 420 from the slot 63. At the same time, the energized resilient member 80 exerts its elastic force to push the other leg 62 out of the hole 16 for unlocking the lock by returning to its original L-shape. The shackle 60 thus is able to pivot about the pin 14 until the stop 610 contacts the housing 10.

Figure 5:
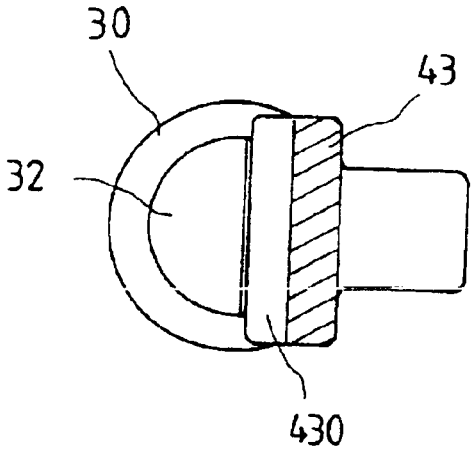
FIG. 5 is a front view in part section showing a projection of the backup locking assembly in a normal position.
Figure 6:
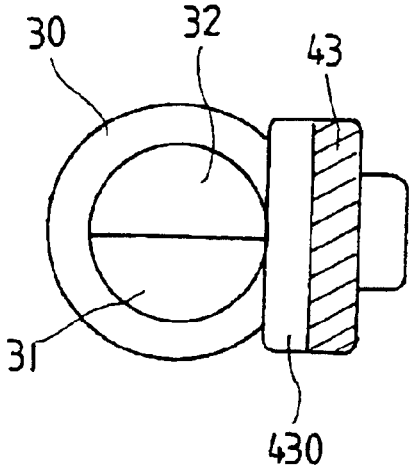
FIG. 6 is a view similar to FIG. 5, where the projection has turned to push an engagement member of the pivot assembly for opening the lock.

Referring to FIGS. 5 and 6 in conjunction with FIGS. 1 to 4, an operation of enabling a person to open the lock either should the combination be forgotten or the combination has been changed by another person who shares the ownership of the lock will now be described in detail below. A person can insert a key 33 into the keyhole to turn the shaft 31 about 90 degrees from the position of the flat of the projection 32 engaged with the rounded end 430 (see FIG. 5) to the position of the sharp edge of the projection 32 engaged with the rounded end 430 (see FIG. 6). At the same time, the engagement member 43 is pushed to pivot the pivot assembly 40. As a result, the dog 420 is disengaged from the slot 63 and the combination lock is unlocked.

While the invention herein disclosed has been described by means of specific embodiments, numerous modifications and variations could be made thereto by those skilled in the art without departing from the scope and spirit of the invention set forth in the claims.

What is claimed is:

1. A combination lock, comprising:

a housing comprising a plurality of parallel, spaced seats each having a substantially half circular recess thereon, an elongate groove adjacent one sides of the seats, a cavity at a side in communication with both the groove and the seats, a channel in communication with both outside and the cavity, a pin in the cavity proximate one end of the groove, a receptacle adjacent the pin, and an opening in communication with both the cavity and outside;

a tumbler wheel assembly supported on the recesses and comprising a plurality of tumbler wheels, a plurality of inner, hollow cylinders each fitted in the tumbler wheel, a bar locked by the cylinders in a locked position, and a flat enlargement at one end adjacent the opening, a first spring put on the bar being compressed between the enlargement and one of the cylinders;

a backup locking assembly disposed in the groove and comprising a keyhole and a rotatable shaft including a projection having a half circular section protruded from an inner end thereof toward the cavity;

a pivot assembly in the cavity and comprising a hole pivotably put on the pin, a latch having a locking dog at an open end, an engagement member engaged with the flat of the projection in the locked position, a base, a protrusion on the base, a protuberance and a second spring compressed between the protuberance and the receptacle;

a push button secured to the pivot assembly at the hole and comprising a nose at an inner side to urge against the enlargement, and an arm urged outward by the protrusion for closing the opening in the locked position;

a U-shaped shackle comprising a first leg pivotably fastened at the housing, a second leg, a slot at one end of the second leg, the slot being engaged with the dog in the locked position;

a cover fitted on the housing; and an L-shaped resilient member having a horizontal portion fastened at a wall of the backup locking assembly and a vertical portion bent by the dog in the locked position, whereby a correct combination of the tumbler wheels will unlock the bar, and a pressing of the push button will push the enlargement and further compress the first spring, thereby pivoting both the push button and the pivot assembly about the pin, compressing the second spring, disengaging the dog from the slot, and exerting an elastic force of the energized resilient member on the second leg for pushing the second leg out of the channel for unlocking the lock by returning to the original L-shape thereof; or a turning of the shaft about 90 degrees by inserting a key into the keyhole will change the flat of the projection engaged with the engagement member in a first position to the sharp edge of the projection engaged with the engagement member in a second position so as to push the engagement member to pivot the pivot assembly, disengage the dog from the slot, and exert the elastic force of the energized resilient member on the second leg for pushing the second leg out of the channel for unlocking the lock by returning to the original L-shape thereof.

2. The combination lock of claim 1, wherein the first leg further comprises an outer stop adjacent an end for limiting a pivot angle of the unlocked shackle.

3. The combination lock of claim 1, wherein each of the first and the second springs is a coil spring.

* * * * *